US009888727B2

(12) United States Patent
Li et al.

(10) Patent No.: US 9,888,727 B2
(45) Date of Patent: Feb. 13, 2018

(54) HEATING ASSEMBLY, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Shuyun Hu, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 15/394,677

(22) Filed: Dec. 29, 2016

(65) Prior Publication Data

US 2017/0105454 A1 Apr. 20, 2017

(30) Foreign Application Priority Data

Dec. 31, 2015 (CN) ..... 2015 2 1122478 U

(51) Int. Cl.

| | |
|---|---|
| ***A24F 13/00*** | (2006.01) |
| ***A24F 47/00*** | (2006.01) |
| ***H05B 1/02*** | (2006.01) |

(52) U.S. Cl.

CPC ..... *A24F 47/008* (2013.01); *H05B 1/0244* (2013.01); *H05B 2203/021* (2013.01)

(58) Field of Classification Search

CPC ..... A24F 25/02; A24F 11/00
USPC ..... 131/329, 328
See application file for complete search history.

(56) References Cited

U.S. PATENT DOCUMENTS

| | | | | |
|---|---|---|---|---|
| 5,145,547 A * | 9/1992 | Chen | B23H 3/00 | 156/345.1 |
| 5,200,706 A * | 4/1993 | Yada | G01N 27/283 | 324/441 |
| 5,398,053 A * | 3/1995 | Hirosawa | B41J 2/0451 | 347/13 |
| 6,720,710 B1 * | 4/2004 | Wenzel | B01L 3/50273 | 310/328 |
| 7,753,686 B2 * | 7/2010 | Kim | H01R 11/12 | 224/675 |

* cited by examiner

*Primary Examiner* — Phuong Chi T Nguyen
(74) *Attorney, Agent, or Firm* — Cheng-Ju Chiang

(57) ABSTRACT

An exemplary heating assembly includes a substrate, a heating part formed on the substrate, an electrode part connected with the heating part, and a liquid conducting body configured for absorbing tobacco liquid. The liquid conducting body is in tight contact with the substrate. The liquid conducting body is capable of conveying the tobacco liquid to the substrate.

8 Claims, 5 Drawing Sheets

HEATING ASSEMBLY, ATOMIZER AND ELECTRONIC CIGARETTE HAVING SAME

TECHNICAL FIELD

The present invention relates to electronic cigarettes, and particularly to a heating assembly, an atomizer and an electronic cigarette using same.

BACKGROUND ART

A typical heating assembly in an atomizer includes a liquid conducting body and a heating wire wrapped around the liquid conducting body. The liquid conducting body is usually made of glass fiber core. However, this kind of heating assembly may be unsuitable for atomizers of large wattage. For example, after assembling, a gap between the heating wire and a surface of the glass fiber core may be uneven. When the heating wire heats in large wattage, the glass fiber core may be burnt due to high temperature, thus rendering user experience unsatisfactory.

What are needed, therefore, are a heating assembly, an atomizer and an electronic cigarette using same, which can overcome the above shortcomings.

SUMMARY

An exemplary heating assembly includes a substrate, a heating part formed on the substrate, an electrode part connected with the heating part, and a liquid conducting body configured for absorbing tobacco liquid. The liquid conducting body is in tight contact with the substrate. The liquid conducting body is capable of conveying the tobacco liquid to the substrate.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
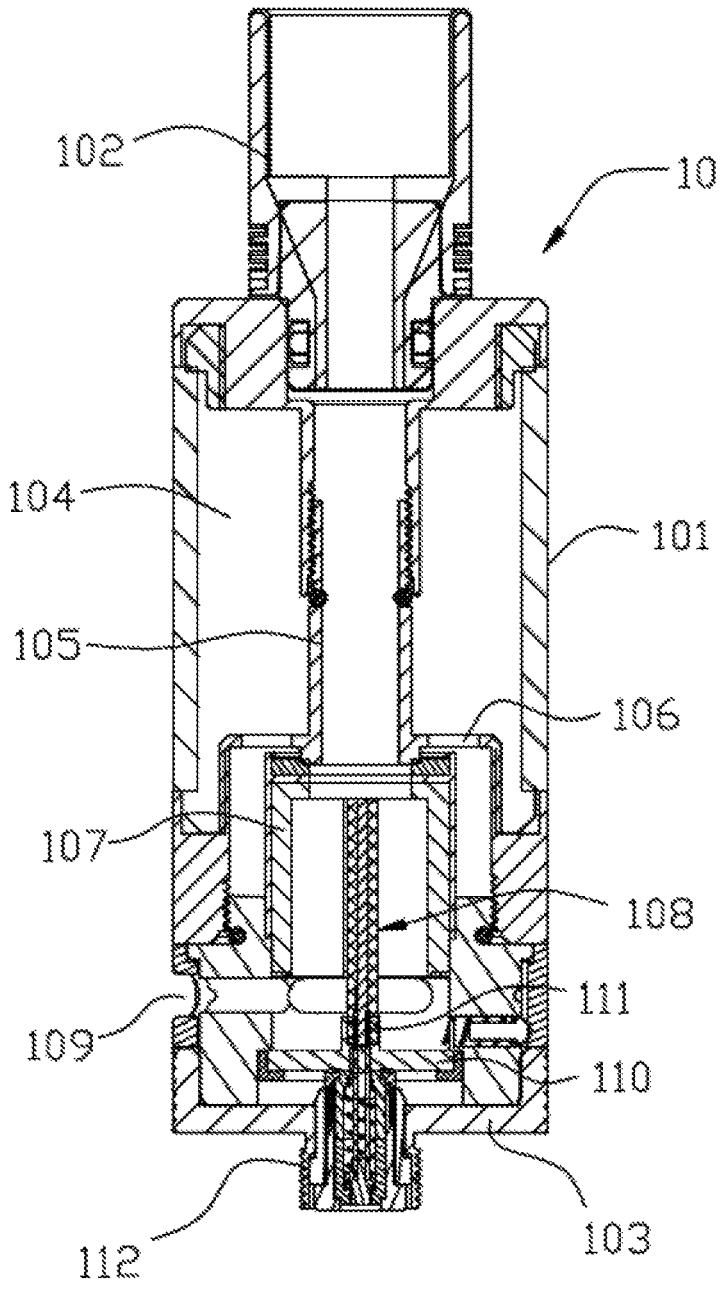
FIG. 1 is a cross-sectional view of an atomizer according to a first embodiment, including a heating assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Referring to FIG. 1, an atomizer 10 for an electronic cigarette is shown. The atomizer 10 includes a housing 101, a mouthpiece 102 at an end of the housing 101, a holder 103 configured (i.e., structured and arranged) for connecting to a power supply. The holder 103 includes a plurality of screw threads 112 at a bottom end. The screw threads 112 are configured for connecting with the power supply. The housing 101 is cylindrical, and defines an air inlet 109 at a bottom part. A liquid chamber 104 and a heating assembly 108 are provided in the housing 101. An air pipe 105 is provided between the heating assembly 108 and the mouthpiece 102. The liquid chamber 104 is defined between the air pipe 105 and the housing 101. Tobacco liquid in the liquid chamber 104 can flow down through the liquid hole 106. The atomizer 10 further includes a bracket 107 configured for fixing the heating assembly 108. The bracket 107 defines at least one gap (not shown). The heating assembly 108 absorbs the tobacco liquid flowed out of the liquid chamber via the at least one gap, and heats the tobacco liquid. In the present embodiment, the heating assembly 108 is a flat sheet, and is vertically fixed in the bracket 107. A front side and a rear side of the heating assembly 108 are positioned in the at least one gap, so that the heating assembly 108 can absorb tobacco liquid. A structure of the heating assembly 108 will be described in detail below. When the user inhales from the mouthpiece 102, external air enters the atomizer 10 via the air inlet 109, and brings aerosol (generated by the heating assembly 108) to pass through the air passage 105, and is then sucked through the mouthpiece 102.

Quite usefully, the holder 103 defines a slot 111 configured for coupling with the heating assembly 108. The heating assembly 108 includes an electrode part engaged in the slot 111 to form an electrical connection. The holder 103 is detachably at a bottom part of the housing 101. A printed circuit board is arranged in the holder 103, and the slot 111 is formed on the circuit board. The slot 111 is similar to a slot in a personal computer, which is configured for coupling with connecting fingers of a memory bank. The heating assembly 108 can be assembled or detached very easily.

Figure 2:
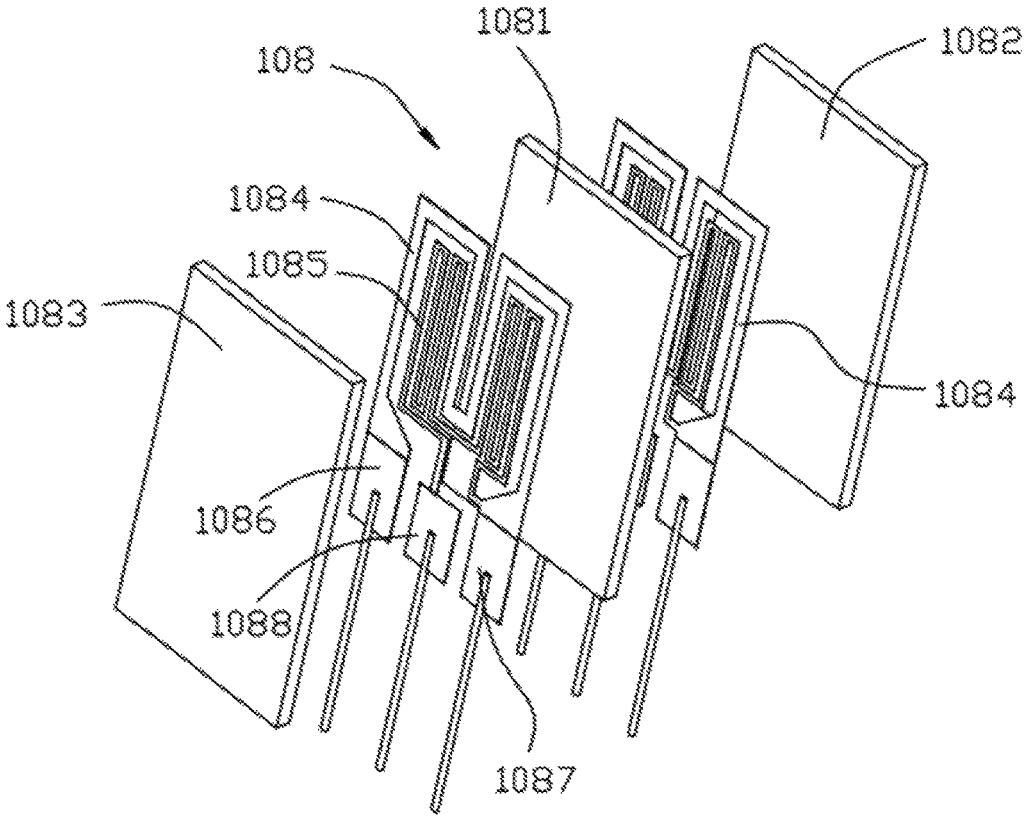
FIG. 2 is an exploded perspective view of the heating assembly in the atomizer of FIG. 1.

Referring to FIG. 2, a heating assembly 108 is shown. The heating assembly 108 includes at least one substrate 1081, a heating part 1084 formed on the substrate 1081, and an electrode part connected with the heating part 1084. The heating assembly 108 further includes liquid conducting bodies 1082, 1083. The substrate 1081 is sandwiched between the liquid conducting bodies 1082, 1083. The liquid conducting bodies 1082, 1083 are in tight contact with the heating substrate 1081, and capable of conveying tobacco liquid to the heating substrate 1081. The electrode part includes electrodes 1086, 1087 configured for connecting with a positive electrode and a negative electrode of a power supply. In the present embodiment, the heating assembly 108 includes three layers, the substrate 1081 is sandwiched between the liquid conducting bodies 1082, 1083, and the substrate 1081 includes heating parts 1084 on two opposite surfaces. It is to be understood that in other embodiments, the heating assembly 108 may include more layers arranged in an alternate fashion.

As seen in FIG. 2, the substrate 1081, the liquid conducting bodies 1082, 1083 are each in the form of a flat sheet. The heating parts 1084 are metallic twists and turns patterns printed or sintered on the substrate 1081, thus increasing a heating surface. The heating parts 1084 may be made of a material selecting from a group consisting of nickel, chromium, titanium, manganese, tungsten, molybdenum and alloy thereof. The heating parts 1084 are integrally formed with the substrate 1081 by printing or sintering, so that the heating parts 1084 can heat as a whole. The heating parts 1084 heat tobacco liquid in the liquid conducting bodies 1082, 1083 on two side surfaces thereof.

Quite usefully, the substrate 1081 is made of ceramic, and the liquid conducting bodies 1082, 1083 are made of micro porous ceramic. The substrate 1081 and the liquid conducting bodies 1082, 1083 are sintered to form an integral structure. The liquid conducting bodies 1082, 1083 can absorbs tobacco liquid slowly. The heating assembly can be assembled into the atomizer 10 conveniently. It is to be understood that, the liquid conducting bodies may be made of porous metal, sponge durable of high temperature, fiber cotton, or glass fiber. Alternatively, the substrate 1081 is made of ceramic, and the liquid conducting bodies 1082, 1083 are cotton fiber layer pressed on surfaces of the substrate 1081.

Quite usefully, to detect a temperature of the heating assembly 108, a thermistor layer 1085 is formed on the substrate 1081. The thermistor layer 1085 is insulated from the heating part 1084. The thermistor layer 1085 is a metallic pattern in a form of twists and turns. The thermistor layer 1085 is made of metal resistance paste of positive temperature coefficient or negative temperature coefficient, and is printed on the substrate 1081. The thermistor layer 1085 includes the common electrode 1087 (also the electrode of the heating part 1084) and an electrode 1088. In use of the electronic cigarette, a temperature controlling circuit of in a power supply can detect a temperature of heating assembly via the thermistor layer 1085, and adjust an output wattage of the heating assembly, so that the temperature of the heating assembly is kept in a stable range. In the present embodiment, the thermistor layer 1085 and the heating part 1084 are formed on an identical side surface of the substrate 1081.

Figure 3:
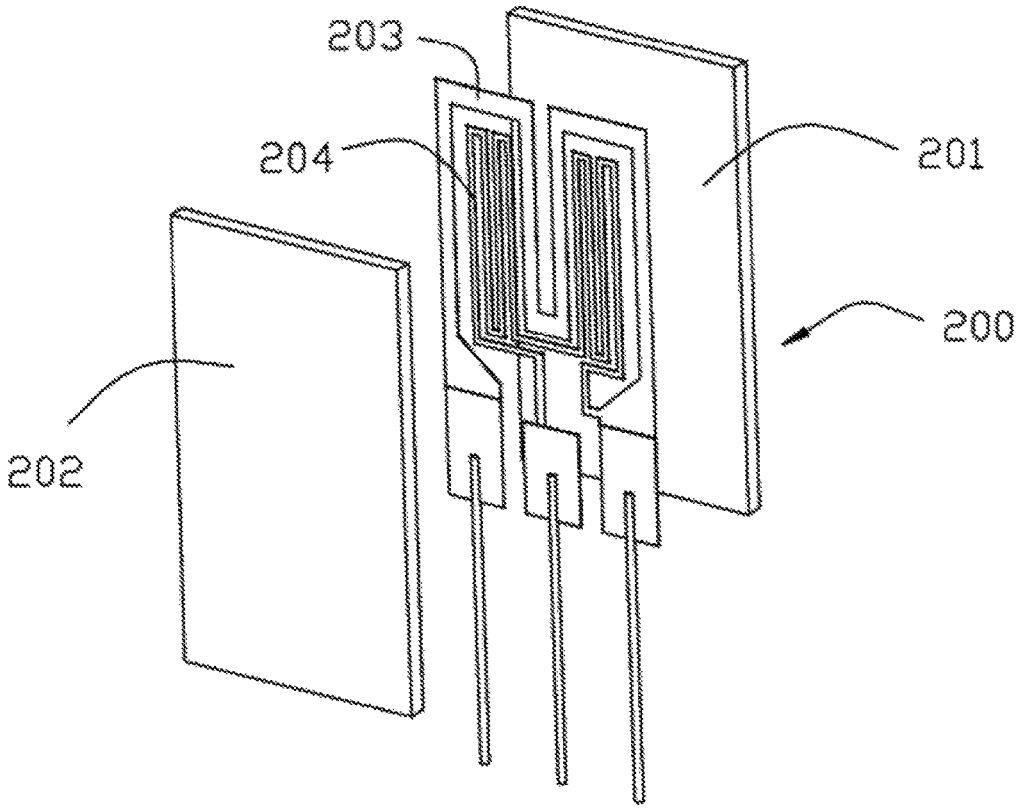
FIG. 3 is an exploded perspective view of a heating assembly according to a second embodiment.

Referring to FIG. 3, the heating assembly 200 in accordance with a second embodiment is shown. The heating assembly 200 includes a substrate 201 and a liquid conducting body 202. The liquid conducting body 202 is integrated with the substrate 201 to form of a flat sheet. The thermistor layer 204 and the heating part 203 are formed on an identical side surface of the substrate 201, which contacts with the liquid conducting body 202.

Figure 4:
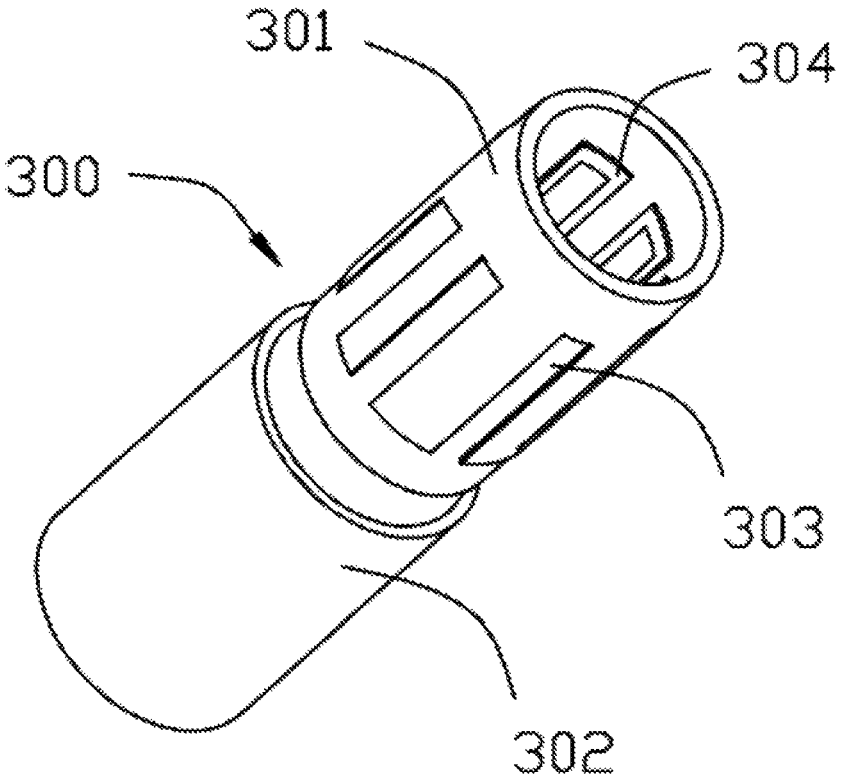
FIG. 4 is an exploded perspective view of a heating assembly according to a third embodiment.

Referring to FIG. 4, a cylindrical heating assembly 300 is shown. The heating assembly 300 includes a cylindrical substrate 301 and a cylindrical liquid conducting body 302. The liquid conducting body 302 nests the substrate 301. The heating part 303 and the thermistor layer 304 are formed on an external side surface and an internal side surface of the substrate 301, respectively. Similar to the above embodiments, the liquid conducting body 302 may be made of micro porous ceramic, and is sintered with the substrate 301 to form an integral structure. Tobacco liquid permeates from the external side surface to the internal side surface, and is heated to form aerosol. The aerosol is then expelled via an internal cavity of the substrate 301. The substrate 301 may further define a plurality of air outlets (not shown), thus facilitating flow of the aerosol.

Figure 5:
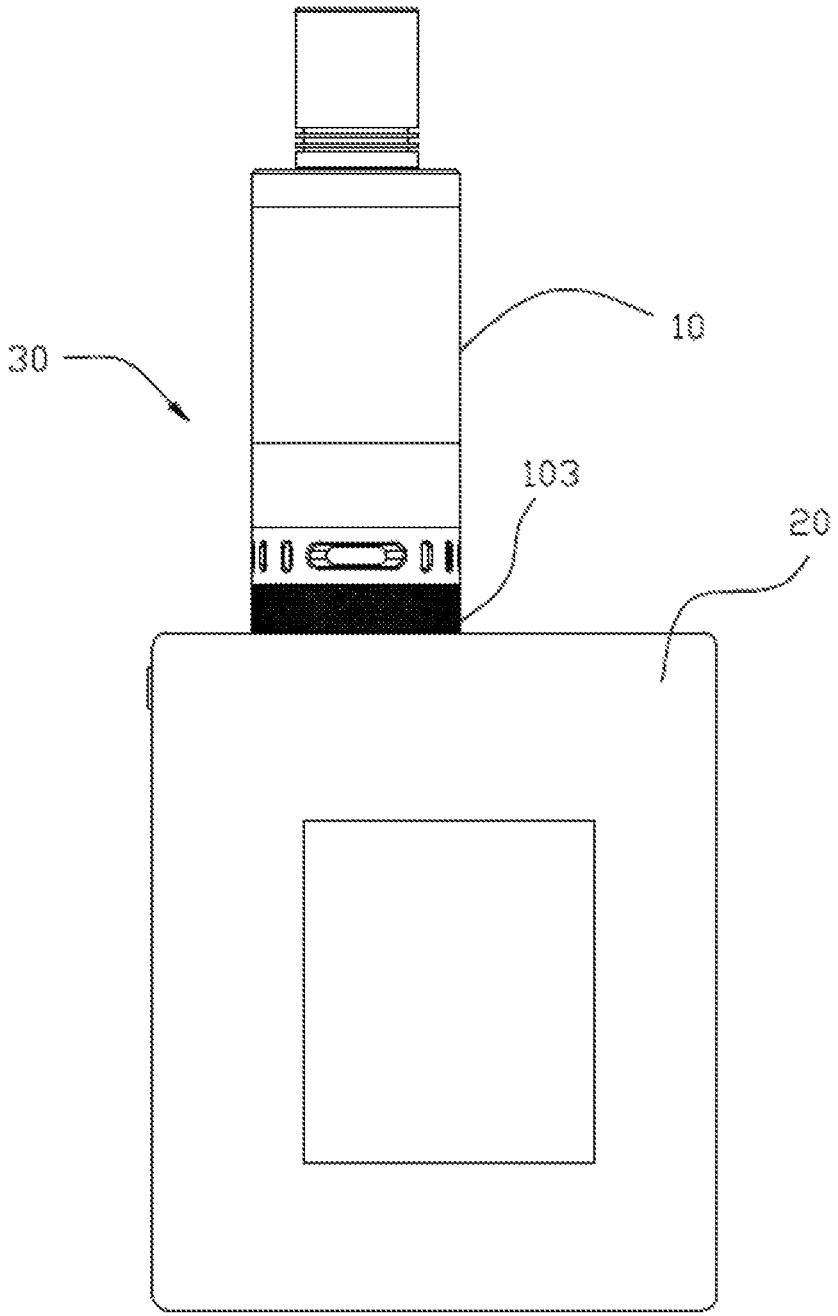
FIG. 5 is a side view of an electronic cigarette according to a fourth embodiment.

Referring to FIG. 5, an electronic cigarette 30 is shown. The electronic cigarette 30 includes the above atomizer 10 and a power supply 20. The power supply 20 is detachably connected with the holder 103, and configured for feeding the atomizer 10 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. A heating assembly, comprising: a substrate; a heating part formed on the substrate; an electrode part connected with the heating part; and a liquid conducting body configured for absorbing tobacco liquid, the liquid conducting body being in tight contact with the substrate, the liquid conducting body being capable of conveying the tobacco liquid to the substrate; wherein the heating part is a metallic pattern in twists and turns, and is formed on a side surface of the substrate in contact with the liquid conducting body; wherein the substrate and the liquid conducting body are each in a form of a flat sheet, or cylindrical.

2. The heating assembly according to claim 1, wherein the substrate is made of ceramic, the liquid conducting body is made of micro porous ceramic, and the substrate and the liquid conducting body are sintered to form an integral structure.

3. The heating assembly according to claim 1, wherein the substrate is made of ceramic, the liquid conducting body is a fiber cotton layer on a surface of the substrate, and the fiber cotton layer is durable of high temperature.

4. The heating assembly according to claim 1, further comprising a thermistor layer formed on the substrate, wherein the thermistor layer is configured for sensing a temperature of the substrate, and insulated from the heating part.

5. The heating assembly according to claim 4, wherein the thermistor layer and the heating part are formed on an identical side surface of the substrate, or the thermistor layer and the heating part are formed on two opposite side surfaces of the substrate, respectively.

6. An atomizer comprising: a housing; a mouthpiece arranged at an end of the housing; a holder configured for connecting a power supply; a liquid chamber in the housing, the liquid chamber being configured for storing tobacco liquid; a heating assembly in the housing;

the heating assembly, comprising: a substrate; a heating part formed on the substrate; an electrode part connected with the heating part; and a liquid conducting body configured for absorbing tobacco liquid, the liquid conducting body being in tight contact with the substrate, the liquid conducting body being capable of conveying the tobacco liquid to the substrate; wherein the heating part is a metallic pattern in twists and turns, and is formed on a side surface of the substrate in contact with the liquid conducting body; wherein the substrate and the liquid conducting body are each in a form of a flat sheet, or cylindrical;

the heating assembly being configured for absorbing the tobacco liquid in the liquid chamber, and heating the tobacco liquid to atomize.

7. The atomizer according to claim 6, wherein the holder defines a slot configured for coupling with the heating assembly, the electrode part is electrically connected to the holder via the slot.

8. An electronic cigarette, comprising:

an atomizer comprising: a housing; a mouthpiece arranged at an end of the housing; a holder configured for connecting a power supply; a liquid chamber in the housing, the liquid chamber being configured for storing tobacco liquid; a heating assembly in the housing;

the heating assembly, comprising: a substrate; a heating part formed on the substrate; an electrode part connected with the heating part; and a liquid conducting body configured for absorbing tobacco liquid, the liquid conducting body being in tight contact with the substrate, the liquid conducting body being capable of conveying the tobacco liquid to the substrate; wherein the heating part is a metallic pattern in twists and turns, and is formed on a side surface of the substrate in contact with the liquid conducting body; wherein the substrate and the liquid conducting body are each in a form of a flat sheet, or cylindrical;

the heating assembly being configured for absorbing the tobacco liquid in the liquid chamber, and heating the tobacco liquid to atomize;

a power supply detachably connected with the atomizer, the power supply being configured for feeding the atomizer power.

* * * * *